US010550652B2

(12) United States Patent
Milner

(10) Patent No.: US 10,550,652 B2
(45) Date of Patent: Feb. 4, 2020

(54) BALLOONING DIAGNOSTICS

(71) Applicant: COVAR APPLIED TECHNOLOGIES, INC., McLean, VA (US)

(72) Inventor: George Martin Milner, Round Rock, TX (US)

(73) Assignee: Covar Applied Technologies, Inc., McLean, VA (US)

( * ) Notice: Subject to any disclaimer, the term of this patent is extended or adjusted under 35 U.S.C. 154(b) by 0 days.

(21) Appl. No.: 15/274,746

(22) Filed: Sep. 23, 2016

(65) Prior Publication Data

US 2017/0081931 A1 Mar. 23, 2017

Related U.S. Application Data

(60) Provisional application No. 62/222,311, filed on Sep. 23, 2015.

(51) Int. Cl.
*E21B 21/08* (2006.01)

(52) U.S. Cl.
CPC ..... *E21B 21/08* (2013.01)

(58) Field of Classification Search
CPC ..... E21B 21/08
See application file for complete search history.

(56) References Cited

U.S. PATENT DOCUMENTS 5,080,182 A * 1/1992 Thompson ..... E21B 49/005 175/48
6,220,087 B1 4/2001 Hache et al.
6,234,250 B1 * 5/2001 Green ..... E21B 47/0003 166/250.03
6,820,702 B2 * 11/2004 Niedermayr ..... E21B 21/08 175/24
8,727,037 B1 * 5/2014 Mouton ..... E21B 21/08 175/25
9,708,898 B2 * 7/2017 Milner ..... E21B 44/00
2003/0079912 A1 * 5/2003 Leuchtenberg ..... E21B 21/08 175/38
2011/0214882 A1 * 9/2011 Santos ..... E21B 21/08 166/373
2013/0220600 A1 8/2013 Bakri et al.
2014/0326505 A1 * 11/2014 Davis ..... E21B 47/0002 175/24
2014/0345940 A1 * 11/2014 Milner ..... E21B 44/00 175/24
2016/0245027 A1 * 8/2016 Gumus ..... E21B 21/08

OTHER PUBLICATIONS

PCT Search Report & Written Opinion (PCT/US2016/053494), dated Dec. 20, 2016.

* cited by examiner

*Primary Examiner* — Manuel L Barbee
*Assistant Examiner* — Raymond L Nimox
(74) *Attorney, Agent, or Firm* — Gregory L. Porter; Hunton Andrews Kurth LLP

(57) ABSTRACT

A system and method for determining if well influx is due to ballooning or a formation kick. The system and method employing flow-in, flow-out, and pit volume data from a series of both pumps-off and pumps-on events. The system determining a standard amount of fluid lost into the formation at a previous pumps-on event and comparing that with the amount of fluid released into the well during a pumps-off event. The system and method producing a confidence reading that the influx is due to ballooning as opposed to a formation kick.

20 Claims, 4 Drawing Sheets

SPECIAL INFLUX FEATURES NOTED

1. INCREASING PVG
2. INCREASING PVG AT PUMP-ON
3. FLOW-OUT INCREASING
4. ✔ PIT VOLUME TRENDING UP AT PUMPS-OFF

BALLOONING DIAGNOSTICS

FIELD OF THE INVENTION

The present invention relates to a methodology for determining if fluid influx into a well during a pumps-off event is caused by the formation ballooning or if the influx is caused by a kick.

BACKGROUND AND SUMMARY

During oil and gas well drilling, the drilling fluid density may be adjusted to balance pore pressure at all or most depths. While pumping fluids, the well bore pressures are typically higher than when the pumps are off. This pressure increase may be due to the friction of the drilling fluid as it flows up the well. The pressure fluctuations due to pumps-on versus pumps-off may cause over pressurization at certain zones in the well such that small fractures may be opened and fluid may be forced into these fractures at the higher pumps-on pressures. When the pumps are turned off, the pressure may drop and the formation at these high pressure zones can then potentially force fluids (or gas) back into the well. The result can be a cycle of transient loss of fluids while drilling followed by fluid (or gas) influx at pumps-off. Historically, this cyclic series of flows and losses is referred to as ballooning or breathing. The influx at pumps-off can be large and is often misinterpreted as a "kick" which is a result of natural pore pressure being higher than the surrounding fluid pressure. The driller's actions for a "kick" (e.g. shut in the well and increase drilling fluid density) can sometimes exacerbate ballooning. It is therefore often important to quickly diagnose an initial influx as either the result of a ballooning cycle or as a "kick".

Traditionally, drillers have relied on human observations of prior fluid loss and generally adopted procedures that may require well shut in and pressure measurements. Inaccurate assessment of prior fluid losses can lead to errors and misdiagnosis of influx as kicks. Drillers sometimes react to ballooning with kick control procedures and thus exacerbate ballooning. This can ultimately lead to an underground blow-out (influx at one depth and fluid losses as a separate depth), with possible environmental damage and loss of the well. What is needed is a way to more accurately determine if well influx is the result of formation ballooning or a kick. It may also be desirable to automate the diagnosis of ballooning by processing real time data, so that drillers may take the correct actions as quickly as is desirable.

Careful analysis of fluid flows and volumes, throughout the time interval from several minutes prior to pumps-off until several minutes after pumps-on, may allow for an automatic assessment of the confidence that fluid losses have initiated and/or begun to increase at pumps-on. This trend in fluid loss is then to be carefully monitored and may be combined with one of many potential influx detection algorithms. After pumps-off, the fluid flow-out patterns may also be processed to determine if flow-out is gradually decreasing (i.e. consistent with ballooning), or is steady, or increasing (i.e. consistent with a "kick"). When influx is first detected, that event may be combined with prior fluid loss information and/or previous flow-out patterns to provide a more accurate assessment of whether the initial influx is due to well ballooning or a kick.

Advanced processing may be applied to flow and volume measurements to allow accurate trend and/or jump detections of changes in well fluid flow (e.g. differences in flow-out and flow-in) at pumps-off and/or pumps-on. Comparison of the differences at these two ends of the pumps-off and pumps-on on cycle may yield new information not previously available.

Definitions

The basic design of ballooning diagnostics system is based in part on the following definitions, Influx—Flow of fluid or gas from the formation into the well.

Kick—An influx from the formation that will not stop if ignored and must be controlled by shutting in the well or increasing the mud weight.

Ballooning—Cyclical influx at pumps off due to over pressurizing well zones during drilling followed by reduced pressure at pumps-off. These transient influx events will diminish and stop at each cycle with no need to shut the well in or increase mud weight.

BRIEF DESCRIPTION OF THE DRAWINGS

FIG. 2 shows one potential graph of the transient measurements of pit volume and flow-out at pumps-off and pumps-on.

DETAILED DESCRIPTION

I. Basic Measurements

Figure 1:
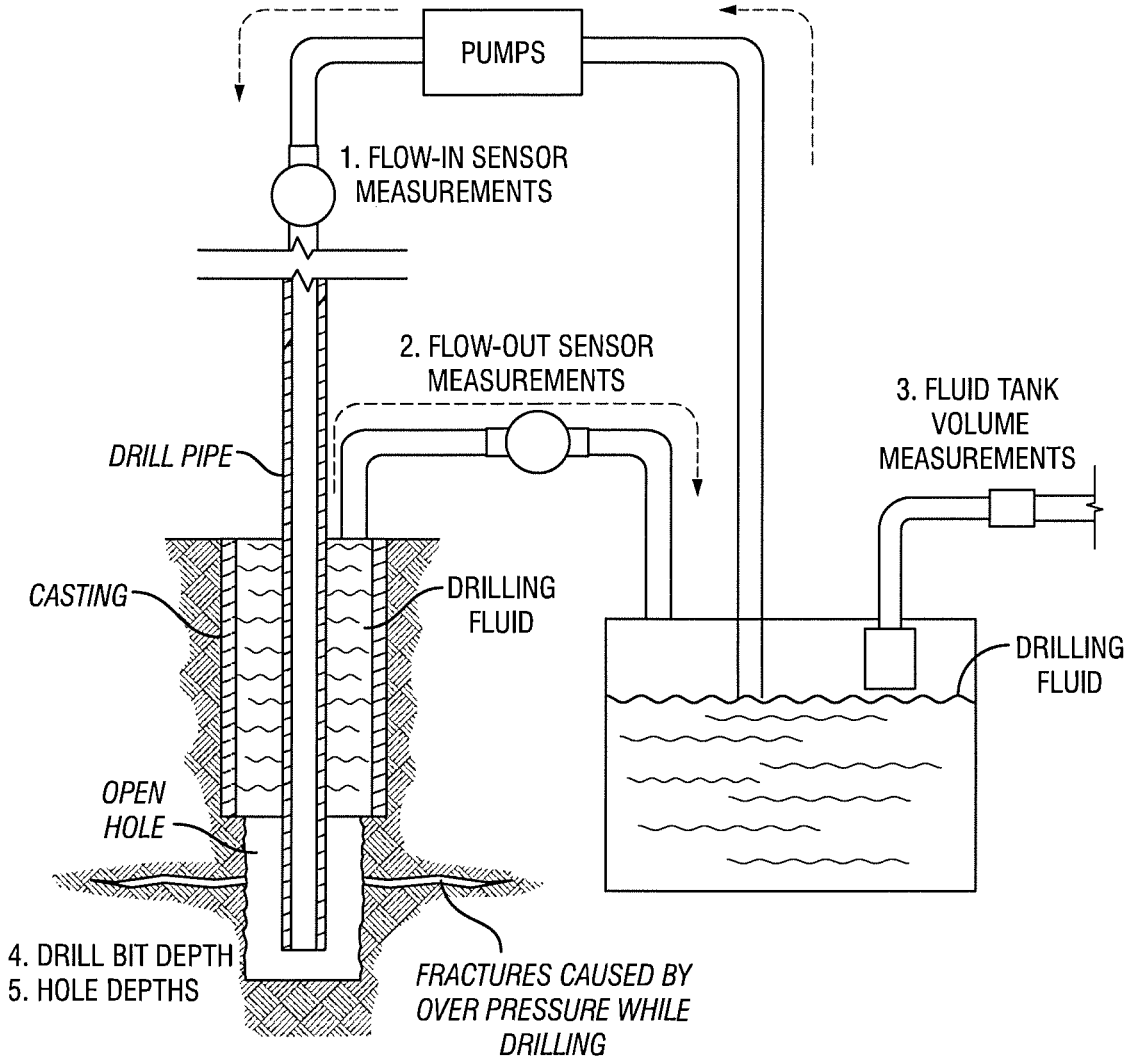
FIG. 1 is a schematic diagram of the relevant oil and gas drilling components which may be desirable for operation of the ballooning diagnostic system.

FIG. 1 depicts a schematic of the relevant oil and gas drilling components which may be desirable for operation of the ballooning diagnostics ("BD") system. As shown in FIG. 1, drilling fluid is typically pumped from a reservoir of drilling fluid down the drill pipe and up the open hole and well casing. Then it is allowed to flow by gravity back to the fluid reservoir. The basic measurements used in the BD system are, 1. Flow-in—the flow rate (e.g. in units of gal/min) at the top of the drill pipe or pump output.
2. Flow-out—the flow rate for fluid exiting from the top of the well casing (also called the bell nipple).
3. Pit volume—the quantity of fluid contained in the fluid reservoir (e.g. in units of gallons).
4. Bit depth—the depth of the drill bit.
5. Hole depth—the depth of the hole.

Each of the above listed measurements are generally available at a well site and are typically measured at time increments between 1 second and 10 seconds. These measurements are typically obtained from dedicated sensors. It will be understood that a far greater number and array of sensors may also be used with the disclosed invention. These additional sensors are generally known in the art. Additionally, duplicate, redundant, or backup sensors may be used to ensure the accuracy and validity of any given measurement or category of measurements. The use of redundant sensors may increase the confidence level of any resulting information.

Figure 2A:
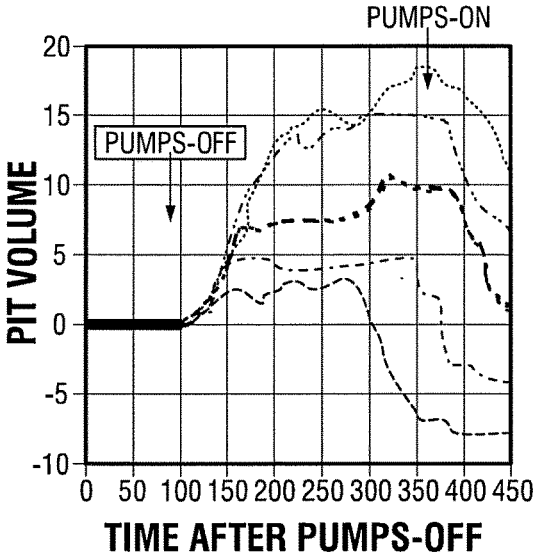
Figure 2B:
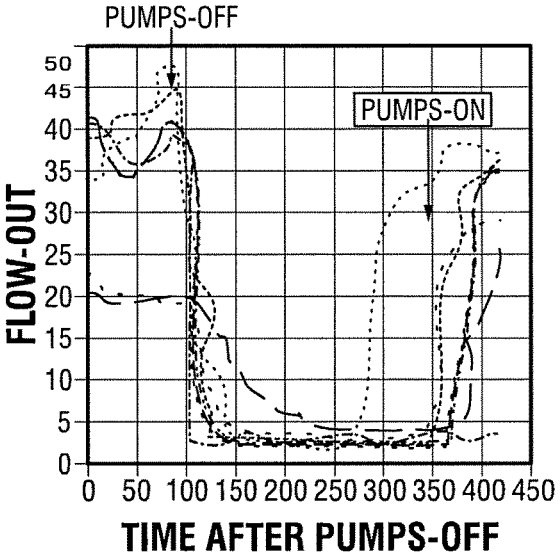

When the pumps are turned off (e.g. to connect a new stand of pipe) transient measurements may be observed in flow-in, flow-out, and/or pit volume. A second set of transients may also be observed in one or all of these measurements when the pumps are turned on. FIG. 2 illustrates an example of these transient measurements for flow-out and pit volume.

II. Ballooning Features

In some embodiments, the BD system processes flow-in, flow-out, and/or pit volume data beginning several minutes prior to pumps-off and/or ending several minutes after pumps-on to extract new features that may have been shown to be associated with ballooning cycles. In some embodiments, the ballooning features extracted are, 1. Larger values of flow-out than expected given the flow-in values at pumps-off.
2. Smaller values of flow-out than expected given the flow-in values at pumps-on.
3. Flow-out values that consistently decrease after pumps-off.
4. Certain "special features" discussed in more detail below.

Figure 3:
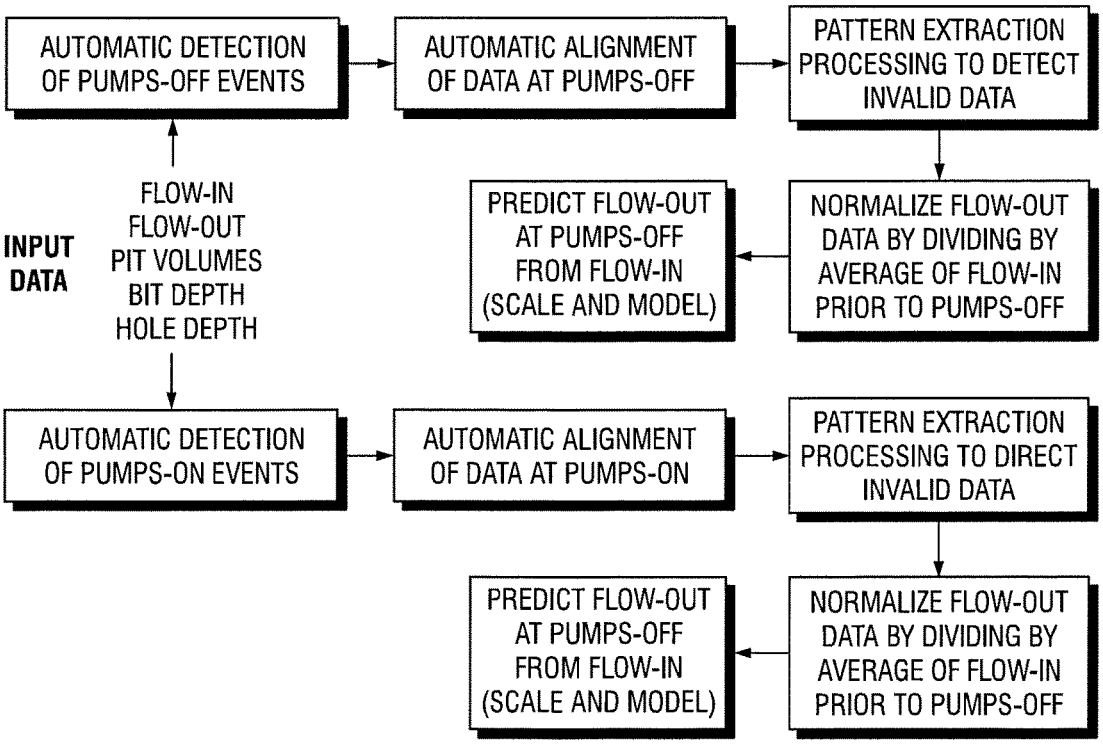
FIG. 3 depicts the initial processing steps of one embodiment applied to extract the ballooning diagnostic system transient features.
Figure 4:
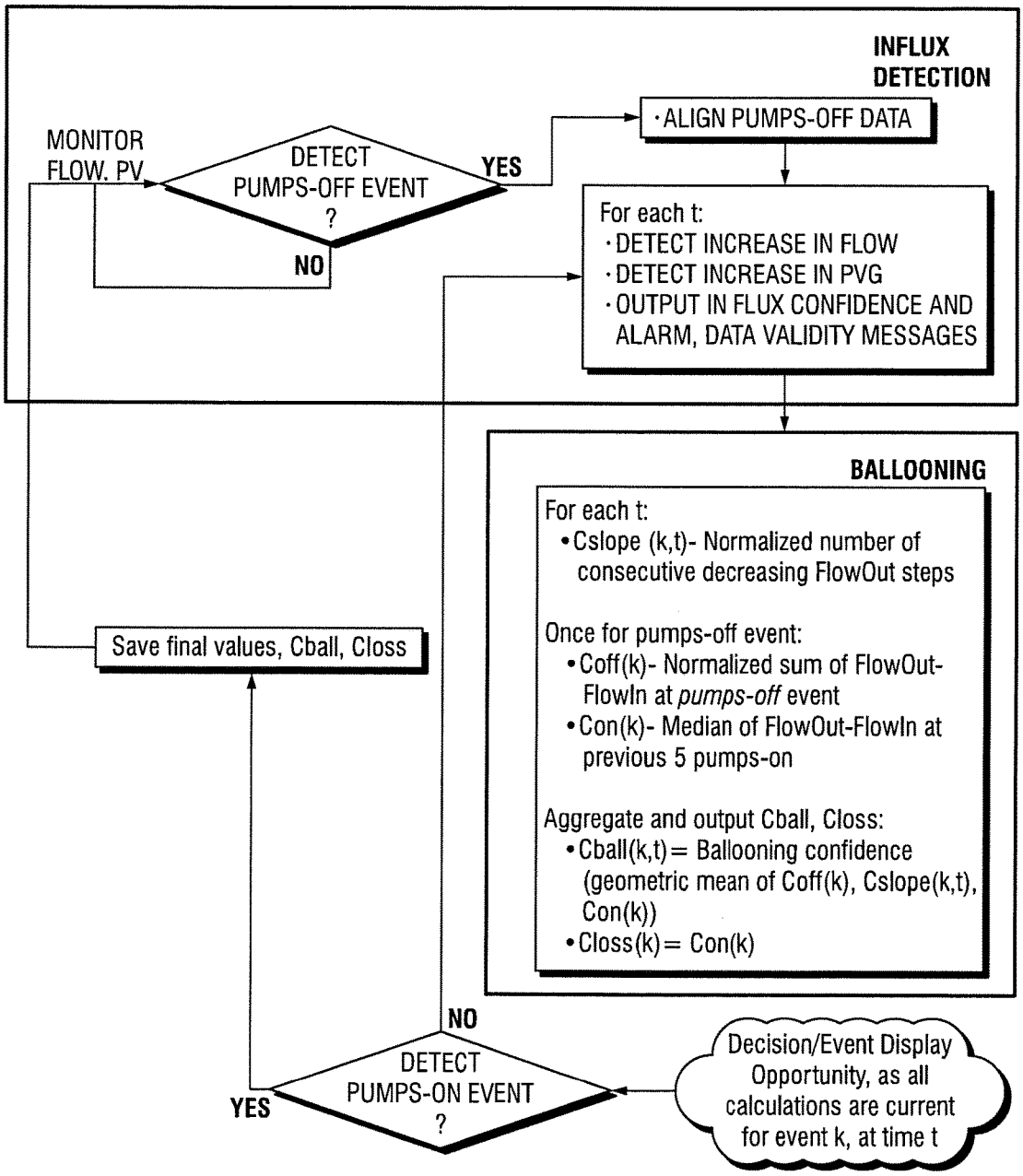
FIG. 4 depicts a potential embodiment of the aggregate ballooning diagnostic system processing steps.

In order to extract these feature values, initial processing may be applied. As shown in FIG. 3, the initial processing of certain embodiments may require the following steps at pumps-off and pumps-on, 1. Automatic pumps-off and pumps-on detection. Pumps-off events may be detected by finding instances when flow-in equals substantially zero and then analyzing the previous flow-in values to determine when a statistically significant decrease in flow-in was first measured. Pumps-on times may be automatically detected when the initial samples for flow-in are significantly greater than zero.
2. Automatic data alignment at pumps-off and pumps-on. Alignment of data to the initial pumps-off time may be desirable in order to accurately compare flow and pit volume values at multiple pumps-off events. A criterion of initial values less than two times the standard deviation of the prior data may be used to select the alignment sample. The pumps-on data may also be aligned to the initial data sample where flow-in is substantially greater than zero.
3. Data validity checks at pumps-off and pumps-on. Miscellaneous unknown well activities and/or sensor errors may result in invalid measured data for one or more of the BD system measurements. A variety of pattern recognition algorithms may be applied to detect when data should not be interpreted as being representative. For example purposes only, a check may be made to determine if any one measurement is consistently zero or otherwise unavailable during the pumps-off to pumps-on interval. An additional data validity check may be made to determine if the drill bit motion from pumps-off to pumps-on is excessive, such that the flow values may be significantly changed by the fluid displacement associated with the motion of a drill bit. In certain embodiments, this data validity calculation may require the values of both drill bit depth and hole depth.
4. Data normalization. In some embodiments, flow values after pumps-off may be normalized by the average value of flow-in prior to pumps-off. The pit volume data may also be normalized by subtracting the values of pit volume at pumps-off.
5. Prediction of flow-out at pumps-off and pumps-on. In certain embodiments, the input flow-in measurements may be used to predict flow-out based on analysis of trends for prior pumps-off and/or pumps-on events. The methods used to calculate these predictions may vary. For example purposes only, one of many techniques which may be implemented is as follows, Compute weighted cumulative sums as follows, $$\mathrm{Dif}(k,ti)=\mathrm{FlowIn}(k,ti)-M(k)*\mathrm{FlowOut}(k,ti) \quad (1)$$

where, k=index for each pumps-off/on event;

ti=sample index;

M(k)=a weighting or scaling function computed by an average of the flow-in and flow-out values prior to pumps-off at event k $$\mathrm{Coff}(k)=\Sigma\mathrm{DifOff}(k,ti) \quad (2a)$$

$$\mathrm{Con}(k)=\Sigma\mathrm{DifOn}(k,ti) \quad (2b)$$

where,

Σ indicates the sum over samples ti with an interval that may depend on well geometries and flow transient times at pumps-off and pumps-on.

DifOff(k,ti)=the difference function defined in (1) evaluated at pumps-off.

DifOn(k,ti)=the difference function defined in (1) evaluated at pumps-on.

An alternate approach for predicting flow-out that may also or alternatively be applied uses prior values of flow-out and flow-in to establish coefficients for a linear regression model of the form, $$\mathrm{FlowOut}(ti)=ao\mathrm{FlowIn}(ti)+a1\mathrm{FlowIn}(ti-m)+a2\mathrm{FlowIn}(ti-2m)+\ldots an\mathrm{FlowIn}(ti-nm) \quad (3)$$

Standard linear regression may be used to calculate the values of ti. The values of m and n may be obtained to minimize errors between measured and predicted values of flow-out during prior pumps-off and pumps-on events. After the regression model is calculated, the differences between measured and predicted flow-out may be processed again using a cumulative sum over fixed interval after pumps-off and pumps-on to compute Coff(k) and Con(k) as described above in equations 2a and 2b.

In some embodiments, the values of Coff(k) and Con(k) defined above may be used as two of the three ballooning feature values as follows, Coff(k)=Larger values of flow-out than expected given the flow-in values at pumps-off may be indicative of initial influx.

Con(k)=Smaller values of flow-out than expected given the flow-in values at pumps-on may be indicative of fluid losses at pumps-on, and thus ballooning.

The third feature often used by the BD system to assess ballooning confidence may be a consistently decreasing slope in flow-out. Several methods of capturing this characteristic may also be applied. For example purposes only, one method may be as follows, 1. Calculate average values of flow-out from pumps-off (Toff) to pumps-on (Ton) over fixed intervals (e.g. 10 seconds).
2. For consecutive segment pairs such that flow-out(k) <flow-out(k−1), increment a total count C(k,i) by 1.
3. Assign a fixed time interval after pumps-off (e.g. 600 seconds) and compute the maximum total possible for C(k,i); (MaxC(k)).
4. Normalize the value of C(k,i) by dividing by MaxC(k) to obtain a feature proportional to the decreasing flow-out slope as follows: Cslope(k,ti)=C(k,i)/MaxCk.

III. Smoothing and Outlier Rejection

Before the values of Coff, Con, and/or Cslope may be used to calculate a final ballooning confidence the values in some embodiments are often processed to remove outliers by computing a standard deviation over prior pumps-off and/or pumps-on events and rejecting values that are outside a pre-determined range. For example, larger than three times the standard deviation. In addition, the values of Con are interpreted as excess loss at pumps-on. It is commonly understood in the field that these losses may begin to occur well before the initial influx may be observed for a ballooning scenario. Therefore, the values of Con(k) may be smoothed by computing a median over prior pumps-off and/or pumps-on events. In some embodiments, a five event median may be computed in order to smooth the values of Con(k). As an example, the five prior values used for Con(k) smoothing for the current event k may be k−1 to k−5 prior to pumps-on for event k, and may be k to k−4 after pumps-on until event k is complete (e.g. approximately 2 to 3 minutes after pumps-on).

IV. Aggregations and Combined Ballooning Confidence

The values of Coff(k), Con(k) and Cslope(k,ti) may be combined to obtain a normalized confidence for ballooning. Several methods may possibly be used to combine the values to obtain a single confidence for ballooning. In one preferred embodiment, the method applied is to calculate the geometric mean for the three feature values to obtain a confidence for ballooning at each pumps-off and pumps-on event (Cball(k,ti)), as $$Cball(k,ti)=(Coff(k)*Con(k)*Cslope(k))^{1/3} \quad (4)$$

The values of Cball(k,ti) may be displayed as the confidence that a given detected influx at pumps-off is due to a ballooning cycle.

V. Special Feature Extractions

In some embodiments, there may be certain patterns in flow and/or pit volume that may override the statistical characteristics of Cball(k,ti), these special patterns may include, 1. Pit volume plateaus then increases after pumps-off, this may reduce ballooning confidence.
2. Pit volume does not decrease at pumps-on, this may reduce ballooning confidence.
3. Flow-out decreases to near zero after pumps-off, this may increase ballooning confidence.
4. Flow-out begins a sustained increase after pumps-off, this may reduce ballooning confidence.
5. Pit volume trending up at pumps-off, this may reduce ballooning confidence.

Special algorithms may be designed to extract certain features that detect the patterns listed above. In some embodiments, if any one of these, or related patterns are detected, the value of Cball(k,ti) may be adjusted accordingly. In some embodiments, the applied algorithm will utilize data from a large array of sensors relating to each component of the drilling operation. In other embodiments, the utilized sensors may be limited to the well circulation system components.

VI. Ballooning Diagnostic Output Display

Figure 5:
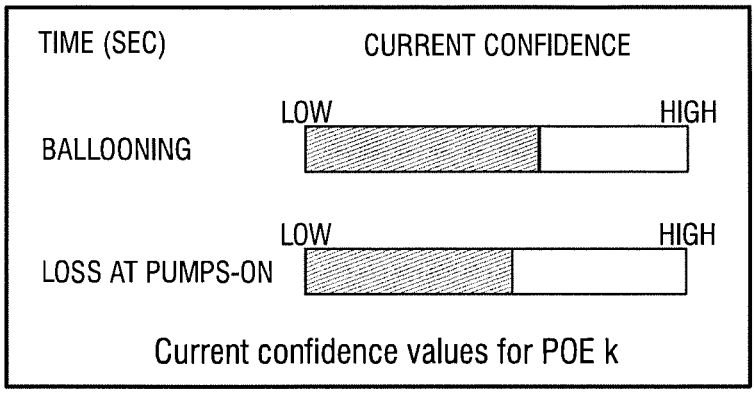
FIG. 5 shows one potential embodiment of the ballooning diagnostic system's display.
Figure 5:
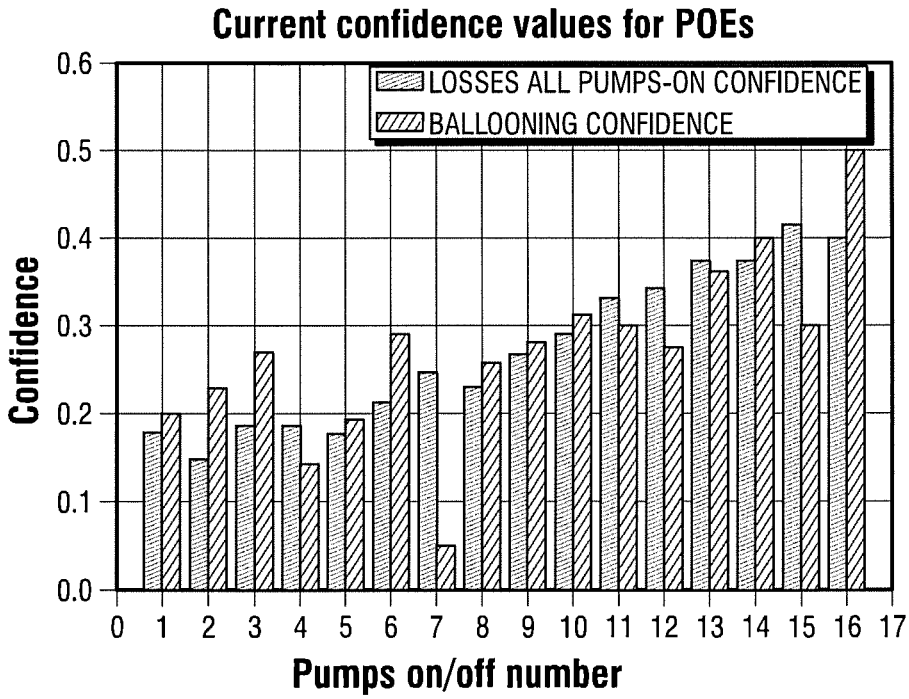

FIG. 5 illustrates one potential embodiment of the BD system display implemented to convey ballooning and fluid loss at pumps-on confidence values to the users for each pumps-off or pumps-on event ("POE").

In a particular embodiment, the top pair of bar graphs in FIG. 5 displays the confidence for ballooning (Cball(k,ti) and confidence for losses at pumps-on (Con(k)) for the current pumps-off or pumps-on event. The lower series of bar graphs in FIG. 5 shows how the confidence values have varied at prior pumps-off and pumps-on events. If any "Special Feature" patterns have been detected, these may be indicated by checkmarks as shown in FIG. 5.

The claimed subject matter is not intended to be limited in scope by the specific embodiments described herein. Indeed, various modifications of the invention, in addition to those described herein, will become apparent to those skilled in the art from the foregoing description. Such modifications are intended to fall within the scope of the appended claims.

What is claimed is:

1. An automated system for determining whether well influx is due to ballooning or a formation kick, the system comprising:

one or more sensors for measuring fluid flow-in, fluid flow-out, and pit volume; and, a processor operably connected to said sensors, wherein said processor obtains fluid flow and pit volume data from said sensors, and analyzes fluid flow and pit volume data for a time period from prior to pumps-off to after pumps-on, wherein said processor compares fluid loss at pumps-on and fluid influx at pumps-off to determine if an influx is due to ballooning and to determine if an influx is due to a kick; and wherein mud weight is increased or a well is shut-in based on a determination that an influx is due to a kick.

2. The system of claim 1 wherein the processor determines a confidence value associated with said determination.

3. The system of claim 2 further comprising a special feature extraction algorithm designed to modify the confidence value based on overriding factors.

4. The system of claim 2, further comprising a kick alarm, said alarm being activated if the confidence value indicates influx due to a kick above a predetermined kick threshold.

5. The system of claim 1, wherein said processor calculates a standard deviation from two or more prior pumps-off and pumps-on events and employs said calculated standard deviation to reject measurements larger than three times the standard deviation.

6. A method for determining whether well influx is due to ballooning or a formation kick, the method comprising:

obtaining data comprising fluid flow-in, fluid flow-out, and pit volume;

detecting pumps-on and pumps-off events;

analyzing said fluid flow-in, fluid flow-out, and pit volume data for a time period from prior to pumps-off until after pumps-on to determine any trend in fluid loss following pumps-on events and influx following pumps-off events; and, comparing fluid loss at pumps-on and fluid influx at pumps-off to determine if an influx is due to ballooning and to determine if an influx is due to a formation kick; and maintaining mud weight in a well based on a determination that an influx is due to ballooning.

7. The method of claim 6, further comprising determining a confidence value associated with said determination.

8. The method of claim 6, further comprising analyzing fluid flow-out following pumps-off to determine if subsequent flow-out is decreasing, increasing or remaining steady.

9. The method of claim 6, further comprising analyzing the average flow-out values over a fixed time interval and determining the slope of flow-out over time.

10. The method of claim 6, further comprising calculating a standard deviation from two or more prior pumps-off and pumps-on events and employing said calculated standard deviation to reject measurements larger than three times the standard deviation.

11. The method of claim 6, further comprising normalizing pit volume data by subtracting the value of pit volume at pumps-off.

12. The system of claim 1, further comprising a display device, operably connected to the processor for displaying a confidence value to an operator.

13. The system of claim 1, wherein the system provides ballooning control procedures or kick control procedures based on the determined cause of influx.

14. The system of claim 1, wherein the system automatically takes remedial action based on the determination of whether an influx is due to ballooning or a kick.

15. The system of claim 14, wherein the remedial action comprises shutting in a well and increasing drilling fluid density in response to a determination that an influx is due to a kick.

16. A system for controlling drilling fluid pressure comprising:

a drilling fluid circulation system, wherein the circulation system comprises a drill pipe in a well, a pump for causing drilling fluid to enter the drill pipe at greater than atmospheric pressure, and a fluid reservoir for storing a volume of drilling fluid; and a processor configured to detect pumps-off events and pumps-on events based on a rate of drilling fluid flowing into the drill pipe, and to determine if an influx of drilling fluid is caused by ballooning and to determine if an influx of drilling fluid is caused by a kick based on the volume of fluid in the fluid reservoir and a rate of drilling fluid flowing out of the well from a time period of 100 seconds prior to a detected pumps-off event to 100 seconds after a detected pumps-on event; and wherein mud density is increased or a well is shut-in based on the determination that an influx of drilling fluid is caused by a kick.

17. The system of claim 16, wherein the system automatically takes remedial action based on the determination of whether an influx is due to ballooning or a kick.

18. The system of claim 16 wherein mud weight is increased and a well is shut-in based on the determination that an influx of drilling fluid is caused by a kick.

19. The method of claim 1, wherein the processor analyzes the average flow-out values over a fixed time interval and determines the slope of flow-out over time.

20. The system of claim 6 further comprising increasing mud weight or shutting in a well in response to a determination that an influx is due to a kick.

* * * * *